US006640776B2

(12) United States Patent
Torii

(10) Patent No.: US 6,640,776 B2
(45) Date of Patent: Nov. 4, 2003

(54) FAIL-SAFE AIR INDUCTION CONTROL APPARATUS

(75) Inventor: Katsuya Torii, Anjo (JP)

(73) Assignee: Denso Corporation, Kariya (JP)

( * ) Notice: Subject to any disclaimer, the term of this patent is extended or adjusted under 35 U.S.C. 154(b) by 68 days.

(21) Appl. No.: 10/026,719

(22) Filed: Dec. 27, 2001

(65) Prior Publication Data

US 2002/0078923 A1 Jun. 27, 2002

(30) Foreign Application Priority Data

Dec. 27, 2000 (JP) ..... 2000-399244
Nov. 7, 2001 (JP) ..... 2001-342481

(51) Int. Cl.[7] ..... F02D 1/00
(52) U.S. Cl. ..... 123/396; 123/399
(58) Field of Search ..... 123/361, 396, 123/399, 397, 398, 400, 403

(56) References Cited

U.S. PATENT DOCUMENTS

| | | | | |
|---|---|---|---|---|
| 5,429,090 A | | 7/1995 | Kotchi et al. | |
| 5,462,026 A | * | 10/1995 | Kumagai | 123/396 |
| 5,467,751 A | * | 11/1995 | Kumagai | 123/399 |
| 5,492,097 A | | 2/1996 | Byram et al. | |
| 6,253,732 B1 | * | 7/2001 | Semeyn et al. | 123/396 |
| 6,286,481 B1 | * | 9/2001 | Bos et al. | 123/399 |
| 6,318,337 B1 | * | 11/2001 | Pursifull | 123/396 |
| 6,345,603 B1 | * | 2/2002 | Abboud et al. | 123/397 |
| 6,382,181 B2 | * | 5/2002 | Wayama et al. | 123/399 |
| 6,408,010 B1 | * | 6/2002 | Stroet | 370/503 |

FOREIGN PATENT DOCUMENTS

| | | |
|---|---|---|
| DE | 4430510 A1 | 8/1995 |
| EP | 0704609 A1 | 4/1996 |
| FR | 2716497 | 8/1995 |
| JP | 3-271528 | 12/1991 |

* cited by examiner

*Primary Examiner*—John Kwon
(74) *Attorney, Agent, or Firm*—Nixon & Vanderhye P.C.

(57) ABSTRACT

A fail-safe mechanism of an air induction control apparatus for automotive engines is provided which is designed to hold a throttle valve at a middle position when a valve actuator has failed to move the throttle valve. The fail-safe mechanism includes a middle position hold stopper, an opener lever connected to the throttle shaft, and a first and a second coil spring. The first coil spring works to exert a first spring pressure on the opener member in a first rotational direction in which the throttle valve is rotated from a fully opened position to the middle position. The first coil spring is urged at an end thereof into constant engagement with the middle position hold stopper to hold the opener member from rotating in a second rotational direction opposite the first rotational direction. The second coil spring has a first and a second end between which the opener member extends. The first end abuts against the middle position hold stopper. The second end abuts against the opener member so as to exert a second spring pressure on the opener member in the second rotational direction to nip the opener member between the second end of the second coil spring and the end of the first coil spring elastically through the first and second spring pressures, thereby holding the throttle valve at the middle position.

9 Claims, 6 Drawing Sheets

FAIL-SAFE AIR INDUCTION CONTROL APPARATUS

BACKGROUND OF THE INVENTION

1. Technical Field of the Invention

The present invention relates generally to a fail-safe air induction control apparatus for automotive engines designed to control the position of a throttle valve electrically using an actuator such as an electric motor, and more particularly to a simple structure of such an air induction apparatus which is capable of holding a throttle valve at a partially opened position accurately in the event of a failure of an actuator.

2. Background Art

In recent years, air induction control apparatuses for automotive engines called electronic throttle systems become used which actuate an electric motor as a function of a pedal stroke operated by a vehicle driver to control the position of a throttle valve. The air induction control apparatus is designed to supply the current to the electric motor in response to a signal from a pedal position sensor which indicates the position of an accelerator pedal and turn the throttle valve through the motor, thereby adjusting the quantity of air entering the engine.

Some of the air induction control apparatuses are designed to hold a middle hold position between a fully closed and a fully opened position using a fail-safe mechanism consisting of a plurality of springs for enabling the vehicle to run in an emergency running mode if the supply of current to the electric motor is cut for some cause.

For example, Japanese Patent First Publication No. 3-271528 discloses an electronic throttle system equipped with a fail-safe mechanism. FIG. 7 shows such a fail-safe mechanism schematically which is designed to hold a throttle valve 13 through a throttle shaft 12 at a middle hold position between a fully opened an a fully closed position within an intake air passage 11 in the event of a failure in supplying an electric motor 20.

The fail-safe mechanism consists of an opener lever 21 moved together with the throttle shaft 12 by the electric motor 20, a middle position hold stopper 14, a fully closed position stopper 15, a middle position hold movable lever 22, a first spring 23 urging the opener lever 21 and the movable lever 22 into engagement with each other, and a second spring 24 urging the movable lever 22 in a direction of closing the throttle valve 13 into engagement with the middle position hold stopper 14. A fully opened position stopper defining the fully opened position of the throttle valve 13 is omitted for convenience of illustration.

In operation, when the electronic throttle system is in service, and it is required to open the throttle valve 13 from the middle hold position, the electronic motor 20 is rotated in a valve-opening direction against the spring pressure exerted by the second spring 24. Conversely, when it is required to close the throttle valve 13 from the middle hold position, the electronic motor 20 is rotated in a valve-closing direction against the first spring 23. If the supply of current to the electric motor 20 is cut for some cause, so that the electric motor 20 outputs no torque, the first and second springs 24 and 23 serve to keep the movable lever 22 in contact with the middle position hold stopper 14, thereby holding the throttle valve 13 at the middle hold position through the opener lever 21. Specifically, a complex mechanism consisting of the opener lever 21, the movable lever 22, and the first and second springs 23 and 24 is used to hold the throttle valve 13 at the middle hold position in the event of a failure in operating the electric motor 20, thus resulting in an increase in manufacturing cost. Additionally, the movable lever 22 is so constructed as to define the middle hold position through engagement with the opener lever 21. Thus, small dimensional errors of the movable lever 22 and/or the opener lever 21 will result in an undesirable shift of the middle hold position.

SUMMARY OF THE INVENTION

It is therefore a principal object of the invention to avoid the disadvantages of the prior art.

It is another object of the invention to provide a simple structure of an air induction apparatus for automotive engines which is capable of holding a throttle valve at a partially opened position accurately in the event of a failure of an actuator.

According to one aspect of the invention, there is provided an air induction control apparatus for an internal combustion engine which is equipped with a fail-safe valve control mechanism. The air induction control apparatus comprises: (a) a throttle valve supported by a throttle shaft rotatably within an intake air passage to control the quantity of intake air flowing through the intake air passage; (b) an actuator working to produces an output which rotates the throttle shaft for opening and closing the throttle valve selectively between a fully closed portion and a fully opened position; (c) a first stopper defining a middle position at which the throttle valve is held between the fully opened and closed positions when the actuator outputs no torque; (d) an opener member connected to the throttle shaft to be rotatable together with the throttle shaft; (e) a first spring winding; and a second spring winding (f). The first spring winding is disposed so as to exert a first spring pressure on the opener member in a first rotational direction in which the throttle valve is rotated from the fully opened position to the middle position. When the actuator produces no output, the first spring winding is urged at an end thereof into constant engagement with the first stopper to hold the opener member from rotating in a second rotational direction in which the throttle valve is rotated from the fully closed position to the middle position. The second spring winding has a first and a second end between which the opener member extends. When the actuator produces no output, the first end abuts against a second stopper, the second end abuts against the opener member so as to exert a second spring pressure on the opener member in the second rotational direction to nip the opener member between the second end of the second spring winding and the end of the first spring winding elastically through the first and second spring pressures, thereby holding the throttle valve at the middle position.

In the preferred mode of the invention, the first and second stoppers may be formed by a one-piece member having a plane against which the end of the first spring winding and the first end of the second spring winding abut.

The first and second stoppers have surfaces rounded so as to establish a point contact with the end of the first spring winding and the first end of the second spring winding, respectively.

A middle position adjusting mechanism may further be provided which is designed to shift a contact of the end of the first spring winding with the first stopper in one of the first and second rotational directions to adjust the middle position to a desired one.

A spring holder may further be provided which works to hold the end of the first spring winding and the first end of the second spring winding from shifting out of engagement with the first and second stoppers. The spring holder may be implemented by pins installed on the opener lever.

The second winding provides an elastic nip to the opener member through the first and second ends of the second winding within a range in which the throttle valve is rotated from the fully opened position to the middle position.

Each of the first and second spring windings is made of a coil spring having a given length extending parallel to the throttle shaft.

The first and second spring windings may be wound in alignment with each other around a shaft extending parallel to the throttle shaft.

The first and second spring windings may be wound in alignment with each other around a shaft extending in alignment with the throttle shaft.

The first and second stoppers may be implemented by a one-piece member formed on a throttle body. The end of the first spring winding and the first end of the second spring winding are joined to each other to form a connection. The connection is urged into constant engagement with the one-piece member when the actuator outputs no torque.

According to another aspect of the invention, there is provided an air induction control apparatus for an internal combustion engine. The air induction control apparatus comprises: (a) a throttle valve supported by a throttle shaft rotatably within an intake air passage to control the quantity of intake air flowing through the intake air passage; (b) an actuator working to produce an output which rotates the throttle shaft for opening and closing the throttle valve selectively between a fully closed portion and a fully opened position; (c) a middle position hold stopper defining a middle position at which the throttle valve is held between the fully opened and closed positions when the actuator outputs no torque; (d) an opener member connected to the throttle shaft to be rotatable together with the throttle shaft; and (e) a spring made up of a first and a second winding and a third spring portion formed by a connection of the first and second windings. An end of the first winding opposite the third spring portion engages a stopper formed on a throttle body so as to produce a first spring pressure which urges the third spring portion in a first rotational direction in which the throttle valve is rotated from the fully opened position to the middle position. An end of the second winding opposite the third spring portion engages the opener member so as to produce a second spring pressure which urges the opener member in a second rotational direction in which the throttle valve is rotated from the fully closed position to the middle position. When the actuator produces no output, the third spring portion is held in engagement with the middle position hold stopper to nip the opener member between the third spring portion and the end of the second winding elastically through the first and second spring pressures, thereby holding the throttle valve at the middle position.

In the preferred mode of the invention, the middle position hold stopper has a surface rounded to establish a point contact with the third spring portion of the spring.

A middle position adjusting mechanism may further be provided which is designed to shift a contact of the third spring portion of the spring with the middle position hold stopper in one of the first and second rotational directions to adjust the middle position to a desired one.

A spring holder may further be provided which works to hold the third spring portion of the spring from moving out of engagement with the middle position hold stopper.

The spring holder may be implemented by pins installed on the opener lever.

The second winding provides an elastic nip to the opener member through the third spring portion and the end of the second winding within a range in which the throttle valve is rotated from the fully opened position to the middle position.

The spring may be made of a coil spring having a given length extending parallel to the throttle shaft. The coil spring may be wound around a shaft extending parallel to the throttle shaft. The coil spring may alternatively be wound around a shaft extending in alignment with the throttle shaft.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
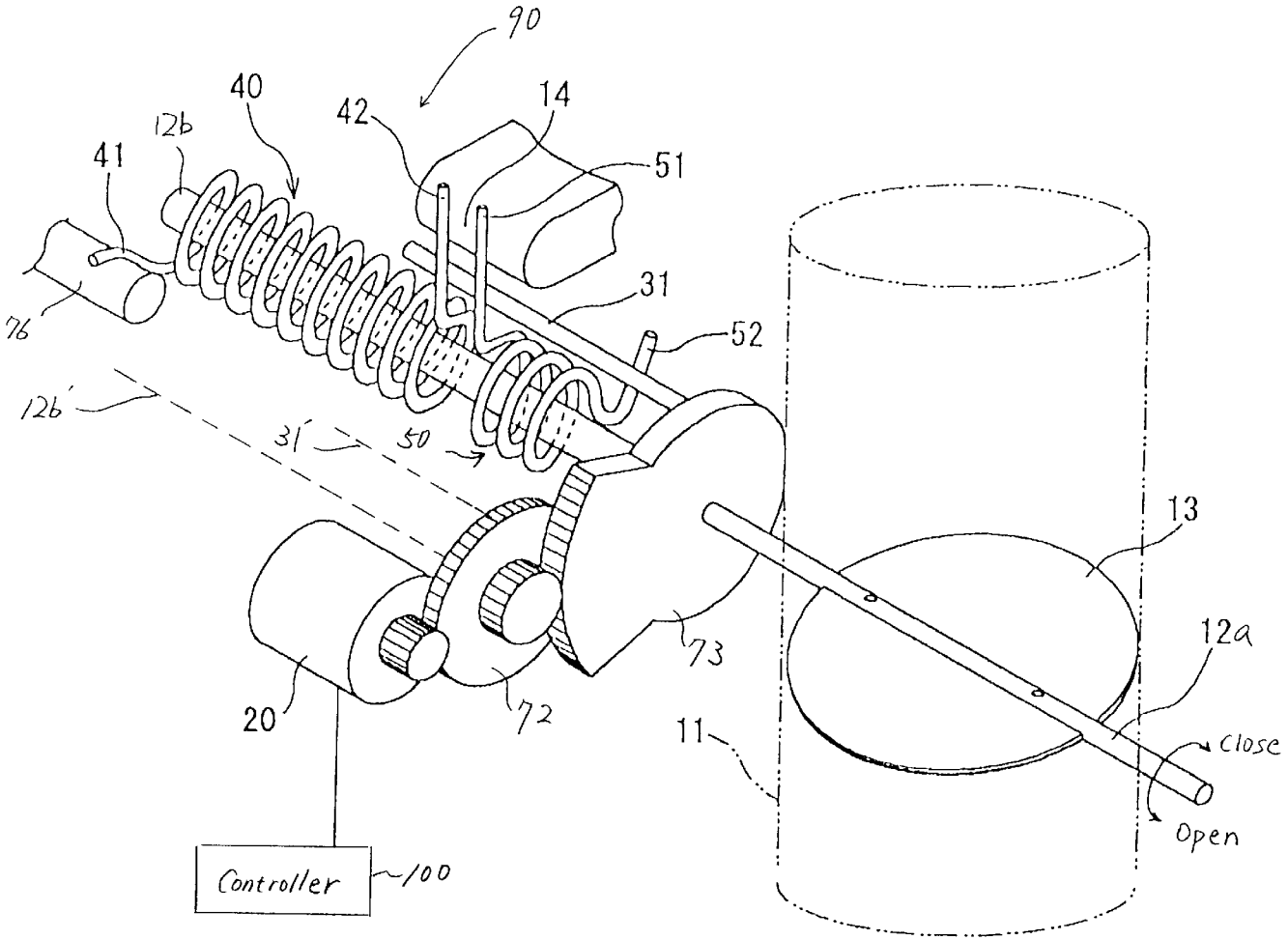
FIG. 1 is a perspective view which shows an air induction control apparatus according to the first embodiment of the invention.
Figure 2:
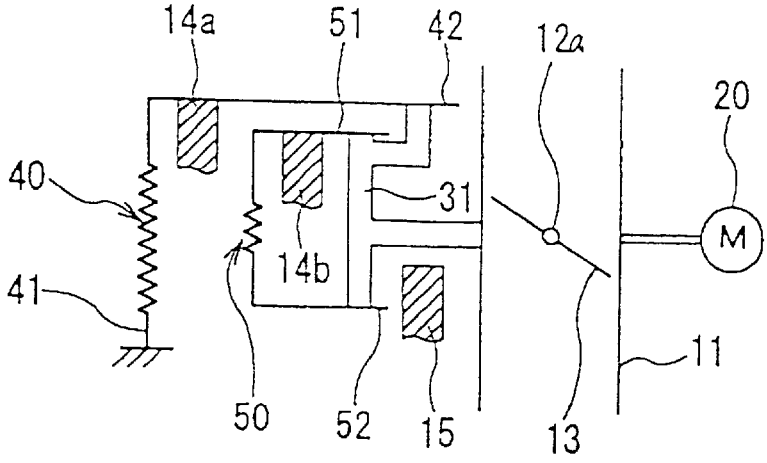
FIG. 2 is a schematic view which shows a structural relation between parts of a fail-safe opener mechanism for holding a throttle valve at a required middle position.

Referring to the drawings, wherein like reference numbers refer to like parts in several views, particularly to FIGS. 1 and 2, there is shown an air induction control device according to the first embodiment of the invention which is built in an electronic throttle system for internal combustion engines of automotive vehicles.

The air induction control device includes generally a throttle valve 13, a throttle opener 90, and a controller 100. The throttle opener 90 works to change the position of the throttle valve 13 as a function a pedal stroke operated by a vehicle operator for controlling the quantity of air flowing into the engine. The throttle opener 90 consists of an electric motor 20, an opener lever 31, a middle position hold stopper 14, and first and second coil springs 40 and 50 and has a fail-safe mechanism working to hold the throttle valve 13 at a middle hold position if the supply of current to the electric motor 20 is cut off for some cause. The throttle valve 13 is installed on a throttle shaft 12*a* pivotably within an intake passage 11 formed in a throttle body. The electric motor 20 connects with the throttle shaft 12*a* through a gear train made up of a first gear 72 and a second gear 73. The throttle shaft 12*a* is retained at an end thereof pivotably by the throttle body and connected at the other end to the second gear 72 in alignment with a throttle shaft 12*b*. The throttle shaft 12*b* is joined at an end thereof to the second gear 73 and at the other end supported pivotably by the throttle body. The throttle shafts 12*b* may alternatively be formed integrally with the throttle shaft 12*a*. The opener lever 31, as shown in FIG. 1, extends substantially parallel to the throttle shaft 12*b* and is joined to the second gear 73 eccentrically to the throttle shaft 12*a* so that it is rotated by an output torque of the electric motor 20 together with the throttle shafts 12*a* and 12*b*. The middle position hold stopper 14 is implemented by a protrusion formed on the throttle body and serves to define the middle hold position at which the throttle valve 13 is held.

The first spring 40 is wound around the throttle shaft 12*b*. The first spring 40 is engaged at an end 41 thereof with a stopper or protrusion 76 formed on the throttle body and at an end 42 with the middle position hold stopper 14. The middle position hold stopper 14 has the top rounded to have a semi-circular section and a ridge extending in parallel to the longitudinal center line of the first spring 40. The second spring 50 is, like the first spring 40, wound around the throttle shaft 12*b* and engaged at an end 51 with the middle position hold stopper 14 and at an end 52 with the opener lever 31. The end 51 of the second spring 50 extends vertically, as viewed in FIG. 1, in contact with one side of the opener lever 52, while the end 52 extends vertically in contact with the other side of the opener lever 52 so that the ends 51 and 52 retains elastically the opener lever 31 therebetween. The middle position hold stopper 14 may be designed so that it slides horizontally, as viewed in FIG. 1, to push the ends 42 and 51 of the first and second springs 40 and 50 for achieving fine adjustment of the middle hold position of the throttle valve 13. The slide of the middle position hold stopper 14 may be accomplished by a screw installed in the throttle body. An example of such a mechanism will be discussed later in detail.

In FIG. 2, the middle position hold stopper 14 is represented for convenience of illustration by a first middle position hold stopper 14*a* against which the end 42 of the first spring 40 abuts and a second middle position hold stopper 14*b* against which the end 51 of the second spring 50 abuts. Surfaces of the first and second stoppers 14*a* and 14*b* against which the ends 42 and 51 abut are, therefore, illustrated as being located at different levels. Similarly, the opener lever 31 is illustrated as having portions located at different levels which contact with the end 42 of the first spring 40 and the end 51 of the second spring 50, respectively. In practice, the middle position hold stopper 14 may have two surfaces formed at different levels against which the ends 42 and 51 of the first and second springs 40 and 50 abut or may be replaced with two separate stoppers having surfaces against which the end 42 of the first spring 40 and the end 51 of the second spring 50 abut and which extend parallel to the opener lever 31 (i.e., the throttle shafts 12*a* and 12*b*) at the same level or different levels.

In FIG. 2, a reference number 15 denotes a fully closed position stopper which defines a fully closed position of the throttle valve 13. The fully closed position stopper 15 is omitted in FIG. 1 for convenience of illustration. Additionally, fully opened position stopper which defines a fully opened position of the throttle valve is also omitted both in FIGS. 1 and 2 because it is not a major part of this invention.

In operation, when the electronic throttle system is in service, and it is required to open the throttle valve 13 from the middle hold position, the controller 100 actuates the electric motor 20 to rotate the opener lever 31 counterclockwise, as viewed in FIG. 1, about the throttle shaft 12*b* against the spring pressure of the first spring 40, thereby moving the throttle valve 13 through the throttle shaft 12*a* in a valve-opening direction (i.e., the counterclockwise direction as viewed in FIG. 1). During the rotation of the opener lever 31, the ends 51 and 52 of the second spring 50 merely follow the rotation of the opener lever 31, so that no spring pressure is applied to the opener lever 31, and thus serve to hold the opener lever 31 only.

Conversely, when it is required to close the throttle valve 13 from the middle hold position, the controller 100 actuates the electric motor 20 and turns the opener lever 31 in a direction reverse to that when opening the throttle valve 13 (i.e., the clockwise direction as viewed in FIG. 1) to urge it against the end 52 of the second spring 50, thereby moving the throttle valve 13 in a valve-closing direction (i.e., the clockwise direction as viewed in FIG. 1). When it is required to close the throttle valve 13 fully, the opener lever 31 is moved until it hits on the fully closed position stopper 15, as shown in FIG. 2. In this operation, the first spring 40 does not act on the movement of the throttle valve 13.

Figure 7:
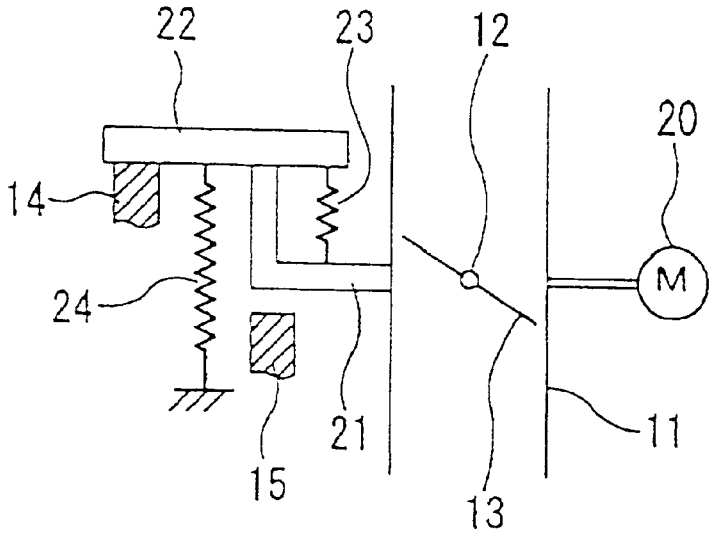
FIG. 7 PRIOR ART
FIG. 7 is a schematic view which shows a structural relation between parts of a fail-safe opener mechanism of a conventional electronic throttle system.

If any failure occurs in the electronic throttle system, and the supply of current is cut, so that no torque is outputted, the end 42 of the first spring 40 is urged clockwise, as viewed in FIG. 1, by the spring pressure of the first spring 40 itself into constant engagement with the middle position hold stopper 14, thereby pushing the end 52 of the second spring 50 through the opener lever 31 in the clockwise direction until the end 42 hits on the middle position hold stopper 14. As soon as the end 42 hits on the middle position hold stopper 14, the end 51 of the second spring 50 hits on the middle position hold stopper 14, so that the opener lever 31 nipped between the ends 51 and 52 of the second spring 50 is held elastically by the end 42 of the first spring 40 and the end 52 of the second spring 50 without rotating in any direction. This causes the throttle valve 13 to be held in the middle hold position through the throttle shaft 12*a*. Specifically, if the electronic throttle system fails to supply the current to the electric motor 20, the throttle valve 13 is kept at the middle hold position, thus allowing a given quantity of intake air to flow into the engine, which enables an emergency running mode of the vehicle. The accuracy of the middle hold position of the throttle valve 13 depends only on the accuracy of machining the protrusion 76 of the throttle body against which the end 41 of the first spring 40 abuts and the middle position hold stopper 14, thus resulting in a decrease in shift of the middle hold position from a desired one as compared with the prior art structure, as illustrated in FIG. 7.

The end 42 of the first spring 40 and the end 51 of the second spring 50, as described above, abut against the same plane of the middle position hold stopper 14, thereby establishing a positional relation between the ends 42 and 51 accurately. This results in precise positioning of the middle hold position of the throttle valve 13.

The middle position hold stopper 14 has, as described above, the top rounded to establish point contacts with the ends 42 and 51 of the first and second springs 40 and 50, thereby keeping the position constant at which each of the ends 42 and 51 hits on the middle position hold stopper 14 each time the throttle valve 13 is brought into the middle hold position.

The second spring 50 continues to nip the opener lever 31 between the ends 51 and 52 from the fully opened position to the middle hold position of the throttle valve 13. Thus, during a period of time when the throttle valve 13 moves between the fully opened position and the middle hold position, the opener lever 31 undergoes the spring pressure produced only by the first spring 40. The force urging the opener lever 31 during such a period of time, therefore, changes linearly, thereby facilitating ease of positioning of the throttle valve 13 between the middle hold position and the fully opened position through the electric motor 20.

The first spring 40 and the second spring 50 have the same diameter and the same pitch between adjacent two of turns of wire, but the number of turns of the first spring 40 is greater than that of the second spring 50.

An angular range (will be referred to as a first angular range below) within which the throttle valve 13 moves between the middle hold position and the fully closed position is narrower than that (will be referred to as a second angular range below) within which the throttle valve 13 moves between the middle hold position and the fully opened position. In other works the middle position hold stopper 14 is located closer to the fully closed position (i.e., the fully closed position stopper 15) than the fully opened position. This is because when the emergency running mode is entered due to any electrical trouble in the electric motor 20, the throttle valve 13 must be held in a positional range which avoids overrevolution of the engine for safety.

The spring pressure produced by each of the first and second springs 40 and 50 acting on the opener lever 31 when the throttle valve 13 is opened or closed may be adjusted by the number of turns thereof. The number of turns of the first and second springs 40 and 50 may be determined as a function of the second and first angular ranges, respectively, thereby enabling the output torque of the electric motor 20 required to move the opener lever 31 within the first or second angular range to be predetermined properly.

The middle position hold stopper 14 is made of a protrusion formed on the throttle body, but instead two adjustable stopper mechanisms, one for each of the first and second springs 40 and 50, may be used which are designed to move horizontally, as viewed in FIG. 1, to change the spring pressures exerted from the first and second springs 40 and 50 on the opener lever 31 when opening and closing the throttle valve 13, respectively.

Figure 3:
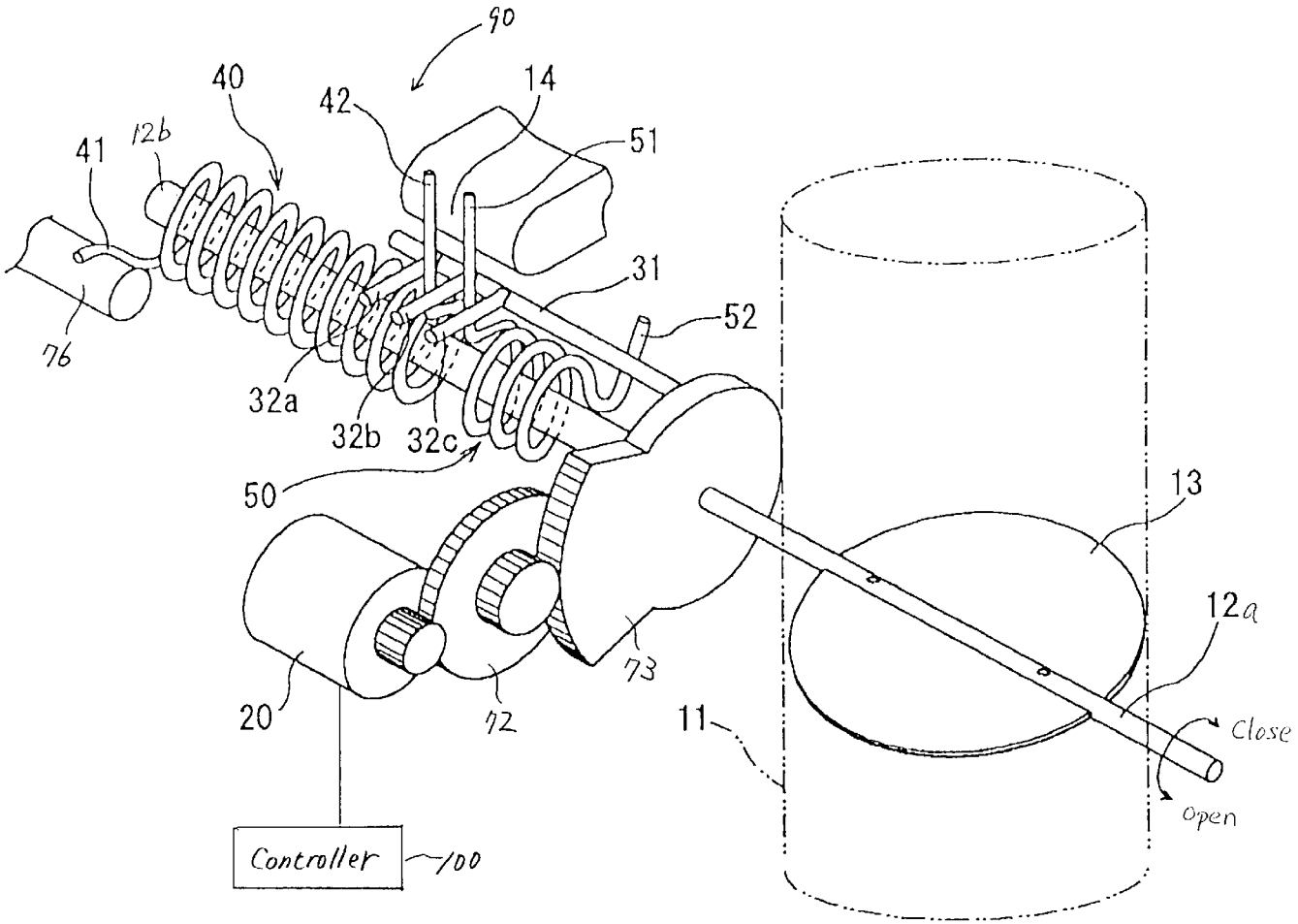
FIG. 3 is a perspective view which shows a modification of the fail-safe opener mechanism of FIG. 1.

The opener lever 31, as shown in FIG. 3, may have installed thereon three stopper pins 32*a*, 32*b*, and 32*c* which extend horizontally, as viewed in FIG. 3. The ends 42 and 51 of the first and second springs 40 and 50 are placed between the pins 32*a* and 32*b* and between the pins 32*b* and 32*c*, respectively, thereby avoiding undesirable longitudinal movement of the first and second springs 40 and 50 along the throttle shaft 12. This ensures mechanical contact of the ends 42 and 51 with the middle position hold stopper 14.

The first and second coil springs 40 and 50 are, as described above, wound around the throttle shaft 12*b* extending in alignment with the throttle shaft 12*a*, but they may alternatively be disposed at another location. For example, the throttle shaft 12*b* having the first and second coil springs 40 and 50 wound therearound and the opener lever 31 may be, as illustrated at numerals 12*b*′ and 31', joined to an end surface of the first gear 72 so that they extend parallel to the throttle shaft 12*a*. The middle position hold stopper 14 and the protrusion 76 are so formed, like the above embodiment, that the end 76 of the first coil spring 40 abuts on the protrusion 76, and the end 42 of the first coil spring 40 and the end 51 of the second coil spring 50 abut against the middle position hold stopper 14. In this case, the first and second coil springs 40 and 50 work to hold the first gear 72 at a given angular position which establishes the middle hold position of the throttle valve 13. Specifically, the first and second coil springs 40 and 50 may be so arranged that when the electric motor 20 outputs no torque, the first coil spring 40 works to urge the throttle shaft 12*a* toward the middle hold position until the first coil spring 40 hits on the middle position hold stopper 14, and the second coil spring 50 works to hold the throttle shaft 12*a* at the middle hold position.

Figure 5:
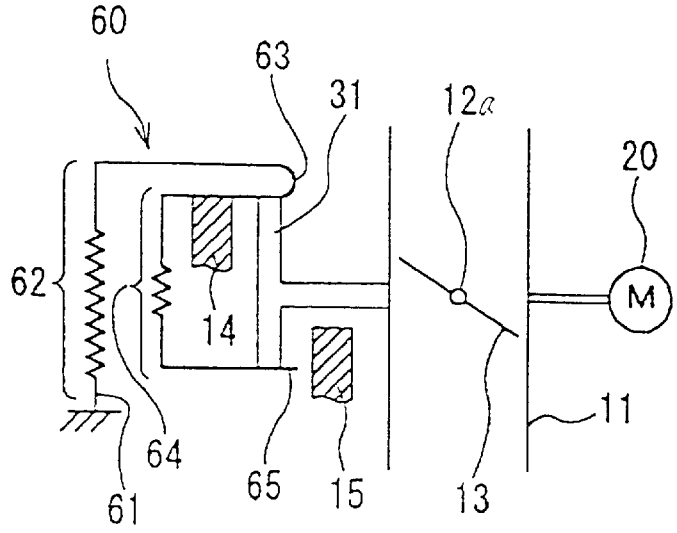
FIG. 5 is a schematic view which shows a structural relation between parts of a fail-safe opener mechanism for holding a throttle valve at a required middle position in the second embodiment.
Figure 4:
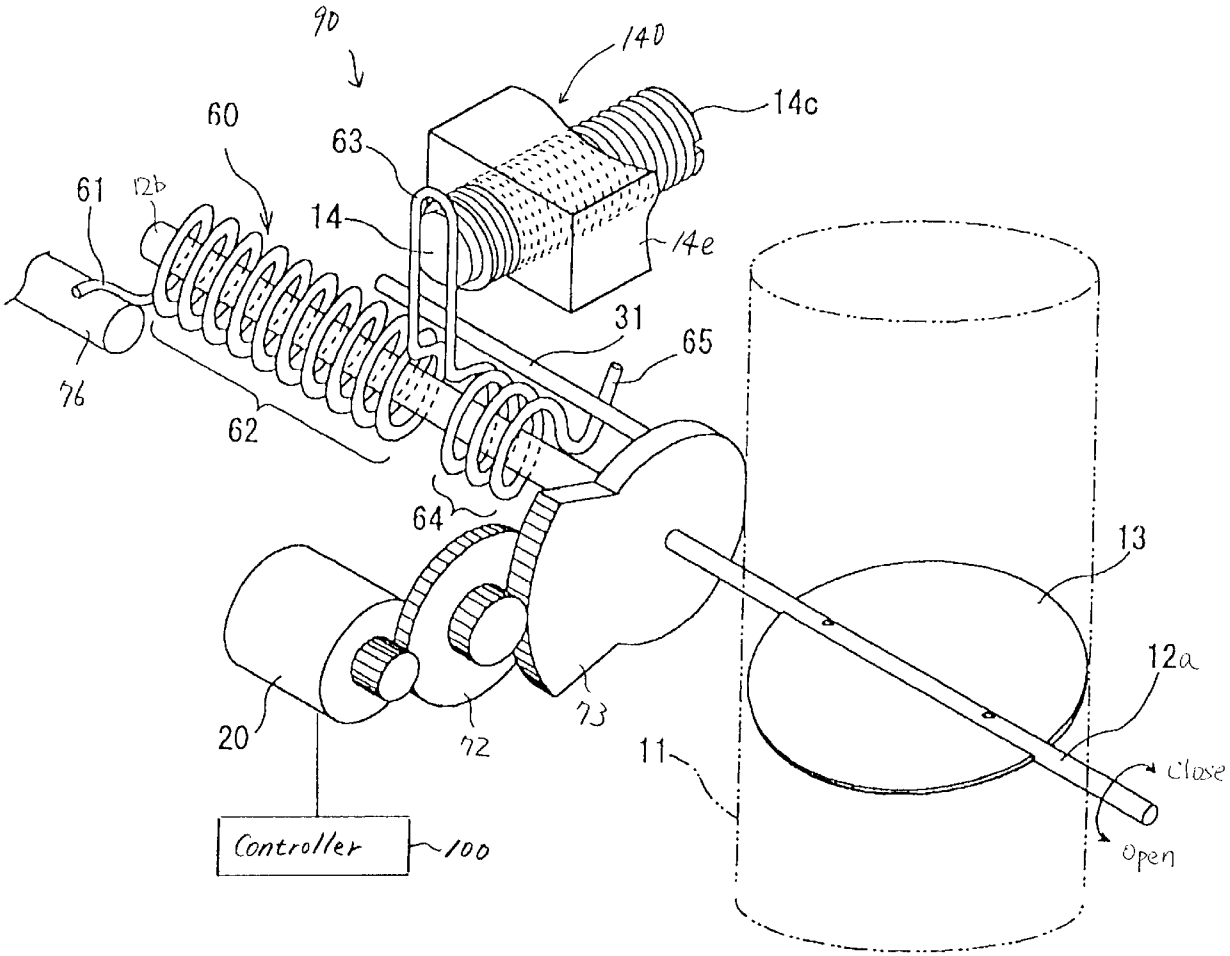
FIG. 4 is a perspective view which shows an air induction control apparatus according to the second embodiment of the invention.

FIGS. 4 and 5 show an air induction control device according to the second embodiment of the invention. The same reference numbers as employed in the first embodiment refer to the same parts, and explanation thereof in detail will be omitted here.

The throttle opener 90 of this embodiment includes a coil spring 60 and a middle hold position adjuster 140.

The coil spring 60 is made of wire wound around the throttle shaft 12*b* and consists of three parts: a first coil 62, a second coil 64, and a U-shaped spring 63 formed between the first and second coils 62 and 64. The first coil 62 is different from the second coil 64, as clearly shown in FIG. 4, in a direction in which the wire of the coil spring 60 is wound. The first coil 62 has an end 61 abutting against a protrusion 76 of the throttle body. The U-shaped spring 63 extends vertically, as viewed in FIG. 4, and is in contact with the middle position hold stopper 14. The opener lever 31 is held or nipped between the U-shaped spring 63 and an end 65 of the second coil 64.

The middle position hold stopper 14 has a head domed to establish two point contacts with the U-shaped spring 63, thereby keeping the position constant at which the U-shaped spring 63 hits on the middle position hold stopper 14 each time the throttle valve 13 is brought into the middle hold position.

The middle hold position adjuster 140 includes a threaded bar 14*c* screwed into a block 14*c* of the throttle body. The threaded bar 14*c* has the middle position hold stopper 14 formed on an end thereof. Turning the threaded bar 14*c*, for example, in a counterclockwise direction, as viewed in FIG. 4, causes the middle position hold stopper 14 to move out of the block 14*c*, thereby urging the U-shaped spring 63 against the spring pressure produced by the first coil 62. This also causes the end 65 of the second coil 64 to move in the counterclockwise direction, as viewed in FIG. 4, so that the opener lever 31 is shifted in a direction of opening the throttle valve 13. Conversely, turning the threaded bar 14*c* in a clockwise direction, as viewed in FIG. 4, causes the middle position hold stopper 14 to move into the block 14*c*, so that the U-shaped spring 63 is shifted in the clockwise direction, thereby resulting in a decrease in spring force produced by the first coil 62 and also shifting the end 65 of the second coil 64 in the clockwise direction. The opener lever 31 is, therefore, shifted in a direction of closing the throttle valve 13. Specifically, fine adjustment of the angular position of the opener lever 31, i.e., the middle hold position is achieved by turning the threaded bar 14*c* in either of the clockwise and counterclockwise directions. Other arrangements are identical with those in the first embodiment, and explanation thereof in detail will be omitted here.

When the electronic throttle system is in service, and it is required to open the throttle valve 13 from the middle hold position, the controller 100 actuates the electric motor 20 to rotate the opener lever 31 counterclockwise, as viewed in FIG. 4, about the throttle shaft 12*b*. The opener lever 31 pushes the U-shaped spring 63 against the spring pressure produced by the first coil 62 to rotate the throttle valve 13 in the valve-opening direction (i.e., the counterclockwise direction as viewed in FIG. 4). During the rotation of the opener lever 31, the end 65 of the second coil 64 follows the U-shaped spring 63, so that no spring pressure is applied to the opener lever 31 and, thus, serves only to hold the opener lever 31.

Conversely, when it is required to close the throttle valve 13 from the middle hold position, the controller 100 actuates the electric motor 20 and turns the opener lever 31 in a direction reverse to that when opening the throttle valve 13 fully (i.e., the clockwise direction as viewed in FIG. 4) to urge the opener lever 31 against the spring pressure exerted from the end 65 of the second coil 64, thereby moving the throttle valve 13 in the valve-closing direction. In this operation, the first coil 62 does not act on the opener lever 31 at all.

If any failure occurs in the electric motor 20, and the supply of current is cut, so that no torque is outputted, the U-shaped spring 63 is urged clockwise, as viewed in FIG. 4, by the spring pressure of the first coil 62 into constant engagement with the middle position hold stopper 14, while the end 65 of the second coil 64 is urged in the counter-clockwise direction to nip the opener lever 31 elastically between the U-shaped spring 63 and the end 65, thereby holding the throttle valve 13 at the middle hold position through the throttle shaft 12*a*.

The structure of this embodiment, as apparent from the above discussion, offers the same advantageous effects as those in the first embodiment, and explanation thereof in detail will be omitted here.

Figure 6:
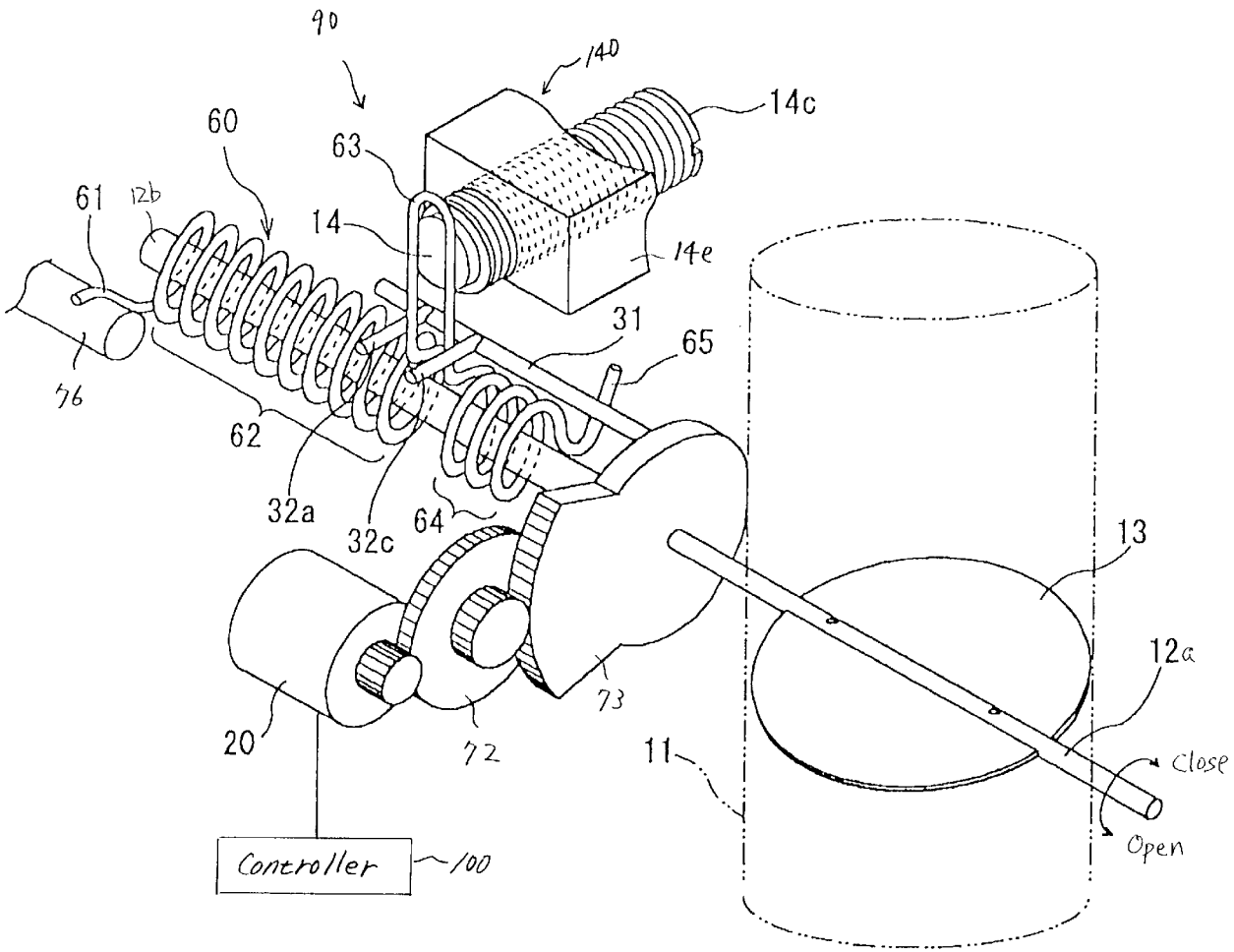
FIG. 6 is a perspective view which shows a modification of the fail-safe opener mechanism of FIG. 4.

The opener lever 31, as shown in FIG. 6, may have installed thereon two parallel stopper pins 32*a* and 32*c* which extend horizontally, as viewed in FIG. 6. The pins 32*a* and 32*c* nip the U-shaped spring 63 therebetween, thereby holding the U-shaped spring 63 from shifting in the longitudinal direction of the throttle shaft 12*b*. This ensures mechanical contact of the U-shaped spring 63 with the middle position hold stopper 14 at all times.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An air induction control apparatus for an internal combustion engine comprising:

a throttle valve supported by a throttle shaft rotatably within an intake air passage to control the quantity of intake air flowing through the intake air passage;

an actuator working to produce an output which rotates the throttle shaft for opening and closing said throttle valve selectively between a fully closed portion and a fully opened position;

a middle position hold stopper defining a middle position at which said throttle valve is held between the fully opened and closed positions when said actuator outputs no torque;

an opener member connected to the throttle shaft to be rotatable together with the throttle shaft; and a spring made up of a first and a second winding and a third spring portion formed by a connection of the first and second windings, an end of the first winding opposite the third spring portion engaging a stopper formed on a throttle body so as to produce a first spring pressure which urges the third spring portion in a first rotational direction in which said throttle valve is rotated from the fully opened position to the middle position, an end of the second winding opposite the third spring portion engaging said opener member so as to produce a second spring pressure which urges said opener member in a second rotational direction in which said throttle valve is rotated from the fully closed position to the middle position, when said actuator produces no output, said third spring portion being held in engagement with said middle position hold stopper to nip said opener member between the third spring portion and the end of the second winding elastically through the first and second spring pressures, thereby holding said throttle valve at the middle position.

2. An air induction control apparatus as set forth in claim 1, wherein said middle position hold stopper has a surface rounded to establish a point contact with the third spring portion of said spring.

3. An air induction control apparatus as set forth in claim 1, further comprising a middle position adjusting mechanism designed to shift a contact of the third spring portion of said spring with said middle position hold stopper in one of the first and second rotational directions to adjust the middle position to a desired one.

4. An air induction control apparatus as set forth in claim 1, further comprising a spring holder working to hold the third spring portion of said spring from moving out of engagement with said middle position hold stopper.

5. An air induction control apparatus as set forth in claim 4, wherein said spring holder is implemented by pins installed on said opener lever.

6. An air induction control apparatus as set forth in claim 1, wherein said second winding provides an elastic nip to said opener member through the third spring portion and the end of the second winding within a range in which said throttle valve is rotated from the fully opened position to the middle position.

7. An air induction control apparatus as set forth in claim 1, wherein said spring is made of a coil spring having a given length extending parallel to the throttle shaft.

8. An air induction control apparatus as set forth in claim 7, wherein said coil spring is wound around a shaft extending parallel to the throttle shaft.

9. An air induction control apparatus as set forth in claim 7, wherein said coil spring is wound around a shaft extending in alignment with the throttle shaft.

* * * * *